United States Patent [19]

Mor et al.

[11] Patent Number: 4,474,660

[45] Date of Patent: Oct. 2, 1984

[54] ELECTROPOLISHING SYSTEM

[75] Inventors: Uri Mor; David Rudolfer, both of Givat Haim Meuhad, Israel

[73] Assignee: Limat Metal Polishing Ltd., Givat Haim Meuhad, Israel

[21] Appl. No.: 523,389

[22] Filed: Aug. 15, 1983

[51] Int. Cl.[3] ..... C25D 17/20

[52] U.S. Cl. ..... 204/213

[58] Field of Search ..... 204/213

[56] References Cited

U.S. PATENT DOCUMENTS

| | | | |
|---|---|---|---|
| 657,646 | 9/1900 | Cruickshank | 204/213 |
| 745,378 | 12/1903 | Paweck | 204/213 |
| 1,251,568 | 1/1918 | Potthoff | 204/213 |
| 1,367,567 | 2/1921 | Sedgwick | 204/213 |

FOREIGN PATENT DOCUMENTS

| | | | |
|---|---|---|---|
| 2158440 | 6/1973 | Fed. Rep. of Germany | 204/213 |
| 45-26360 | 8/1970 | Japan | 204/213 |

*Primary Examiner*—Thomas Tufariello

*Attorney, Agent, or Firm*—Browdy and Neimark

[57] ABSTRACT

An electropolishing system includes a plurality of basket-like containers, supported on a stepping rotatable shaft, and are immersible in an electrolyte filled tub. At each shaft position parts to be electropolished are piled up on the containers' bottom sides. Each container has a door-forming side which, for parts' loading purposes is positioned to be the container's top side, and for parts' unloading is positioned as the bottom side, when the shaft with its containers are in a raised position above the electrolyte containing tub. Power is applied only when the shaft is at one of its stationary positions.

6 Claims, 4 Drawing Figures

ELECTROPOLISHING SYSTEM

The present invention generally relates to metal polishing and, more particularly, to a system for electropolishing metal parts which is uniquely advantageous for electropolishing reasonably small metal parts.

The need and/or desirability to treat the surface of metallic objects is well known. One technique, used to so treat metal is known as electropolishing. In this technique the metallic object to be treated is immersed in any one of known current-conducting liquids, generally referred to as electrolytes. Electric power of desired amperage and voltage are passed for a controlled period through the electrolyte, in which the metal objects are immersed until the desired treatment, in term of finish and depth of polish are achieved. It is obvious that the most important result is that the surface be treated uniformly and evenly over its entire area. This means that the surface, after treatment, be free of any blemishes and of any areas which for some reason were not treated properly or evenly.

With present day electropolishing techniques, relatively large metal objects can be polished quite satisfactorily. Typically, one or more such objects are suspended in the electrolyte bath, so that the entire surface of each object is exposed to the electrolyte, thus producing an even, uniform polished surface. The problem however arises when small objects which either cannot be suspended easily or not at all, such as screws, bolts or pieces of metal which do not have hooks, holes or handles have to be so plated.

Herebefore, an electropolishing machine for electropolishing such small objects has been developed. However, it is very unsatisfactory for the following reasons. The machine which can be analogized to a washing machine, consists of a drum, rotatable about a horizontal shaft, and contains electrolyte, in which the small pieces to be electropolished are immersed. The drum rotates as the electrical power is passed through the electrolyte. As the drum rotates the pieces tumble therein, making and breaking contact with each other, and therefore producing sparking. Such sparking causes serious blemishes to appear on the surfaces of the pieces. Also, due to gravity, pieces at the bottom of the pile in the drum are subjected to less tumbling than those on top. Thus, uneven exposure of the pieces to electrolyte occurs, resulting in uneven surface polishing. Also, all the machine loading and unloading is done manually, which increases the polishing cost.

Thus a serious need exists for a system which eliminates practically all the prior art disadvantages. Such a system is provided by the system of the present invention which comprises:

- a tub-like structure adapted to contain preselected electrolyte;
- a shaft steppingly rotatable in said electrolyte about an axis so as to assume n positions during each complete shaft rotation;
- at least one container, adapted to contain therein parts to be polished, connected to said shaft so that in at least some of the shaft positions the parts in said container are immersed in said electrolyte; and
- control means including means for controlling the stepping rotation of said shaft and for controlling the application of electric power at selectable voltage and current to said electrolyte only when said shaft is at one of said positions in a non-rotary state.

In a preferred embodiment a plurality of containers are connected to the shaft, e.g. four containers, symmetrically distributed about the shaft and n is equal to 4. The four shaft positions are chosen so that at each position one container is above the shaft, one below it and the other two on either side thereof. Each of the containers has one side, which is the most remote from the shaft and which serves as a door, through which parts to be polished are loaded into the container and unloaded after polishing. As will be apparent from the following description, a unique arrangement is employed to load and unload the parts automatically.

The novel features of the invention are set forth with particularity in the appended claims. The invention will best be understood from the following description when read in conjunction with the accompanying drawings.

Figure 1:
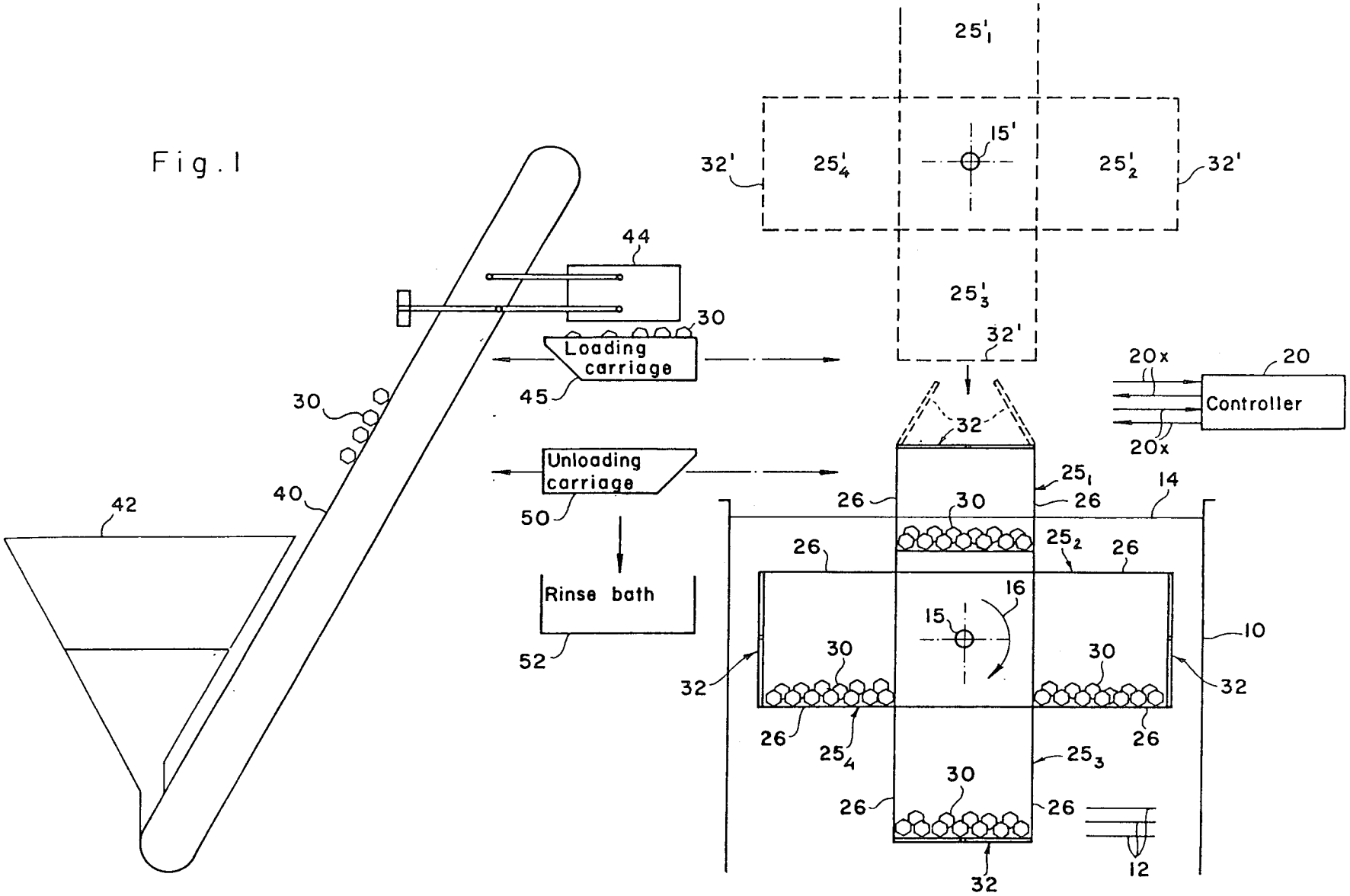
FIG. 1 is a simplified diagram of the invention, used to describe all features of one embodiment.

Attention is first directed to FIG. 1 in connection with which a basic embodiment of the invention will be described. It should be clear however that the invention is not intended to be limited thereto. In FIG. 1 a relatively large tub-like structure 10 in which an appropriately chosen electrolyte, represented by lines 12 is contained up to a chosen level, represented by dashed line 14. A rotatable shaft, designated by 15, which extends horizontally in structure 10, is provided. The shaft by means of appropriate mechanical electrical means controlled by a controller 20 is steppingly rotatable about its axis. That is, the shaft is made to rotate a selected number of degrees, stopped for a selected period and then rotated in the same direction the same number of degrees and stopped once more. Thus, the shaft assumes several stationary positions after each full rotation thereof. For the particular arrangement, shown in FIG. 1, the number of positions is four. After each 90 degree rotation of the shaft it is stopped at a new position for the chosen period, and then stepped once more. In FIG. 1 the shaft is assumed to rotate clockwise (CW), as represented by arrow 16.

Connected to the shaft 15 are a plurality of containers 25. For a shaft stepped to be in four positions, during each revolution four containers are provided. They are designated by $\mathbf{25_1}$, $\mathbf{25_2}$, $\mathbf{25_3}$ and $\mathbf{25_4}$. They are fixedly connected to the shaft so that at each shaft position one of them (e.g. $\mathbf{25_1}$) is above shaft 15, one ($\mathbf{25_3}$) below the shaft, and the other two ($\mathbf{25_2}$ and $\mathbf{25_4}$) on either side of the shaft. Each container, which is preferably cube shaped, is formed of flat mesh-like sides, generally designated by 26 so that the electrolyte 12 is free to flow in and out of the container and thus come in contact with any matter, such as metal parts to be polished. In FIG. 1 the small x's 30 designate such parts. Thus, even though parts 30 are in the containers, they are freely exposed to the electrolyte to be electropolished thereby, due to the electrochemical reaction which is produced as a result of the electric power applied to the electrolyte. The principles of electropolishing are well known in the art and therefore will not be described in further detail.

Each container has one side which serves as a door, which is designated by 32, to distinguish it from the other sides of the container. The door side will hereafter also be referred to as the door 32. Each container is connected to the shaft so that its door 32 is the most remote side from the shaft 15. It should therefore be apparent that due to the shaft rotation at each of its positions the door of each container is differently oriented as to its relative position in the container. When a container is above the shaft, such as container $25_1$, the door 32 is the container's top side, while serving as the bottom side when the container is below the shaft, as shown for container $25_3$. When the container is either to the right or to the left of the shaft the container's door assumes the role of the right or left side, respectively. The door 32, except for the fact that it can be opened and closed to enable parts to be loaded into the container for polishing or be removed therefrom after polishing has taken place, is like any other container side, in that it is mesh-like so that electrolyte can flow therethrough.

In each shaft position one side of each container acts as its bottom side. The containers are connected so that at each shaft position their bottom sides are horizontally aligned. And, due to gravity any parts 30 therein tend to pile up on the bottom sides. As shown in FIG. 1 in container 25, which is above the shaft the door 32 is the top side of the container, so that any parts 30, loaded into this container, pile up on the most remote side thereof, which serves as the bottom side. However, in the container which is below the shaft 15, e.g. container $25_3$ since the door 32 serves as the bottom side, the parts 30 pile up thereon.

To load the containers the shaft is steppingly rotated, so that each of them assumes the position above the shaft such as that shown for $25_1$, in which the door 32 is at the top. The door is then opened, unless it is already open. In FIG. 1 the door 32 of container $25_1$ is shown in a closed position by the solid lines and in the open position by the dashed lines, which represent a two-part door. Such a door, though preferable, is not intended to limit the invention thereto. If desired, a one part door may be employed.

Once the door is opened the container is ready to be loaded with parts 30. The loading may be done manually. However, in a preferred embodiment, loading is performed automatically with a measured quantity of parts, as will be described. Preferably, to prevent electrolyte splashing at least the upper part of the container which is being loaded is above the electrolyte. After the loading operation the door is closed by the controller and the shaft is steppingly rotated, e.g. CW by 90 degrees to position the next container for loading. This operation continues until all the four containers are loaded with parts 30 to be polished.

It should be apparent that when parts 30 are loaded into a container, due to gravity they pile up on the horizontally oriented bottom side of the container. However after loading, shaft rotation and the assumption of a new position another side of the container becomes the bottom side. During the actual shaft rotation as it rotates from one position to the next, the parts in each container are scrambled and repile themselves once more on the container bottom side, when the shaft assumes the new position.

In accordance with the present invention during the entire loading operation no electric power is applied through the electrolyte. Only after all the containers are loaded is power applied, which starts the polishing process. However, the power is applied only when the containers are stationary. That is, when the shaft does not rotate and is at one of the positions. Since the bottom sides on which the parts are piled are flat and horizontally oriented, the parts, once piled up on the bottom sides, are stationary as long as the containers are not moved, i.e. are stationary. Consequently, sparking, which in the prior art occurs due to relative movement of parts which respect to one another, does not happen in the present invention. As is known, sparking occurs due to the "making" and "breaking" of contacts between parts, through which current flows. This is most significant since sparking tends to produce blemishes on the plated surfaces, which is most undesirable.

It should also be pointed out that with the present invention a large number of small parts which are piled up in the several containers are polished at the same time, without having to suspend each part separately. After a chosen polishing period the power is turned off and the shaft is rotated by 90 degrees so that the containers assume a new position in the tub 10. Alternately stated, each container assumes the position of its preceding container in the tub. As the shaft and the containers turn, the parts in each of them are scrambled and are repiled therein once the shaft rotation stops, with all the containers' bottom sides horizontally aligned. Such scrambling and repiling is desirable to insure uniform exposure of the surface area of each part to electrolyte. Only after the containers assume the new stationary position, is power applied once more, to continue the polishing process.

This process continues for a period predetermined to be sufficient to properly polish the parts in the containers, based on their metallic properties, size and desired finish for the particularly chosen power input. Clearly during this period each of the containers assumes more than one position to insure proper parts' scrambling, when power is off, so as to properly expose their entire surface areas. The period, the rate of rotation of the shaft, the lengths of stationary periods of the containers as well as the power, in terms of voltage and current, are controllable by the controller, based on operation chosen parameters.

It should be pointed out that in a preferred embodiment, unlike the prior art, the power is applied by using the shaft which is electrically conductive as one electrical terminal, e.g. the positive (+), and the tub 10 as the other terminal, e.g. the negative (−). The containers are also formed of electrically conductive metal and they are at the same potential as the shaft. Thus current flows through the electrolyte from the tub to the containers and the parts 30, which are in electrical contact therewith.

After the polishing operation is completed and the power is turned off the parts are ready to be removed from the containers. Clearly, different arrangements and/or techniques may be used to remove the polished parts from each container. For example, each container may be successively positioned above the shaft, like container 25 and then remove the parts through the door 32 at the top, i.e. in a reverse way the container was loaded. In accordance with a preferred embodiment the shaft and the containers which are attached thereto are supported by a mechanical arrangement which enables the shaft with the containers to be raised to a selected height above the top of tub 10 for parts' unloading purposes. After the parts are unloaded the shaft with the containers are lowered into the tub and immersed again in the electrolyte for a subsequent operation.

The shaft with the containers in the raised position are shown by the dashed lines, in which the basic elements, like those described, are designated by like numerals except that they are primed, e.g. 15', $25_1$', 32', etc.

From the foregoing it should be apparent that once the shaft and the containers are in the raised position the door 32 of the container below the shaft, such as container $25_3$, serves as the bottom side on which the polished parts 30 are piled up. Thus by opening this door, the container $25_3$ can be emptied out. The other containers can be equally easily emptied out by steppingly rotating the shaft to position each of them below the shaft and opening its door 32.

Once all the polished parts 30 are removed, the shaft and the containers, with the doors either open or closed, are returned into the tub 10 and each of the containers is reloaded with new parts to be polished, as herebefore described.

It should again be stressed that various arrangements may be used to load and unload the parts 30 into and from the containers. In accordance with the present invention in a preferred embodiment these aspects of the process are all automated under the control of the controller. Briefly, the loading operation is performed when the shaft and the containers are in the tub 10. The doors of the top container are open. In response to a command from the controller a conveyor belt 40 carries parts 30 from a parts' source or hopper 42 upwardly, until the parts drop onto a weight or scale 44. Located below the latter is a carriage 45. When an amount of parts, by weight, is measured by scale 44 it supplies a signal to the controller which in turn stops the conveyor belt and opens the scale bottom, thus enabling the weight-measured parts to fall into carriage 45. Then the carriage 45 is commanded by the controller to travel toward the tub 10, and when reaching a preselected point above the open door 32 of the top container the carriage is stopped and caused to unload the part into the container below it. This can be done with a carriage 45 which either pivots about an axis to spill out its contents or with a carriage with an openable bottom. The weighed amount of parts 30 corresponds to the amount of parts to be loaded in each container.

Once the content of the carriage 45 has been emptied into a container, several steps have to take place. The carriage 45 is returned to its position under the scale 44. Also, the door of the loaded container is closed and then the shaft is stepped to position another empty container above the shaft with the container's door open. These steps may be performed sequentially, or substantially simultaneously. However, once they have taken place the controller again activates the conveyor belt to feed parts to the scale 44, and load the next container, as herebefore described.

After all the containers have been loaded with parts 30 to be polished, the polishing process takes place, as herebefore described. As to unloading the finally polished parts 30, the shaft and the containers are first raised out of the tub under the control of the controller. After a controlled time period has elapsed, to permit electrolyte to drain out of the containers back into the tub, unloading takes place. An unloading carriage 50, which is typically stationed above a parts' receiver, e.g. a rinse bath 52, is commanded to move and be positioned below the container which is below the shaft. By commanding the door 32 of the latter to open the polished parts automatically fall into the carriage 50. Thereafter the carriage is commanded to return to its position above the rinse tub 52. Once reaching this position, the carriage 50 unloads its load into the bath 52, either by spilling its load into it or by opening its bottom side to cause the parts to drop into the bath 52, due to gravity.

Once the carriage 50 has been unloaded, the shaft 15 is stepped to place another loaded container below the shaft and the unloading cycle is repeated. This cycle is repeated several times until each of the four containers has been emptied out and its contents transferred by the unloading carriage 50 to the rinse bath 52. Therefrom the polished parts are handled as in any conventional polishing process.

From the foregoing it should be apparent that with the automated parts' loading and unloading, once the parts are loaded into hopper 42 their loading into the various containers and, more importantly, their unloading after being polished is performed automatically without any manual handling. This enhances the polishing process in that the parts, once polished, are not manhandled until they are rinsed and treated so as not to affect their polished surfaces.

It should also be apparent that all the steps, previously described can be performed automatically without human intervention once various parameters, such as the needed electric power, the polishing period and the number of positions each container is to occupy during that period are established and set in the controller. Thus the foregoing description is clearly sufficient to enable one familiar with the art to practice the invention.

For example, scale 44, when loaded by the established amount (weight) of parts 30, may activate a microswitch to supply a signal to the controller. Upon receipt of such signal the controller could stop the driving motor of the conveyor belt 40 and also activite an appropriate mechanical device e.g. a door of scale 44 to empty its contents into carriage 45. After a preselected time, which can be defined by a timer in the controller, a signal would be supplied by the controller to activate a motor of the carriage 45 to move it to be above the open top container. This position can be sensed by a microswitch which would close (or open) once the carriage reaches the desired position. The closure (or opening) of the microswitch could be sensed by the controller which in turn will cause the carriage to dump its load into the container. It should be apparent that the controller can be implemented with switches, relays, timers and the like, to perform the steps, herebefore described. In FIG. 1 the bands to and from the controller 20 are designated by 20x. Also, if desired a microprocessor can be programmed by well known techniques to control the described sequence of steps.

As previously pointed out in one embodiment the shaft and containers are at the positive (+) potential and the tub 10 at minus (−) potential. In said embodiment the shaft was formed of titanium-lined copper, while the containers were formed of meshed titanium. As to the large electrolyte-containing tub 10 it was formed of SS 316L.

Figure 2:
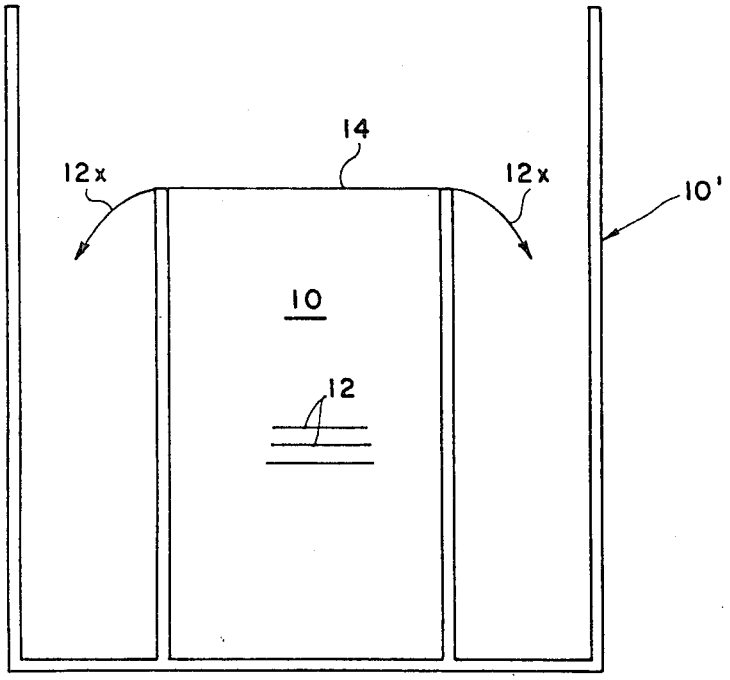
FIG. 2 is a cross-sectional diagram of an embodiment of a special electrolyte tub, with overflow provisions.

It has been found that for enhanced polishing results it is desirable to have a relatively constant volume of electrolyte which is circulated in and out of the tub at a selected rate. To this end in one embodiment, the tub 10 is placed in a larger outer tub of larger width, length and height. The latter is shown in cross-sectional side view in FIG. 2 and is designated by 10'. It effectively forms spill ways for receiving some electrolyte which fills tub 10 and tends to spill over into tub 10' as more electrolyte is introduced into tub 10. The spilled-over electrolyte is designated by 12x.

Figure 3:
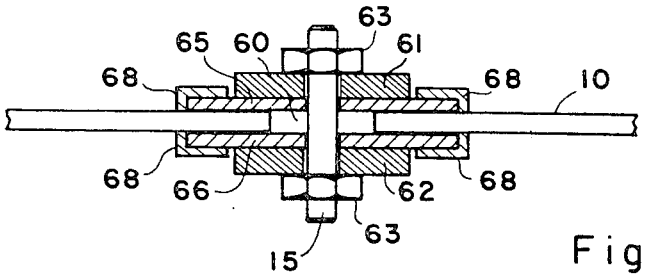
FIGS. 3 and 4 are diagram of a unique liquid seal.
Figure 4:
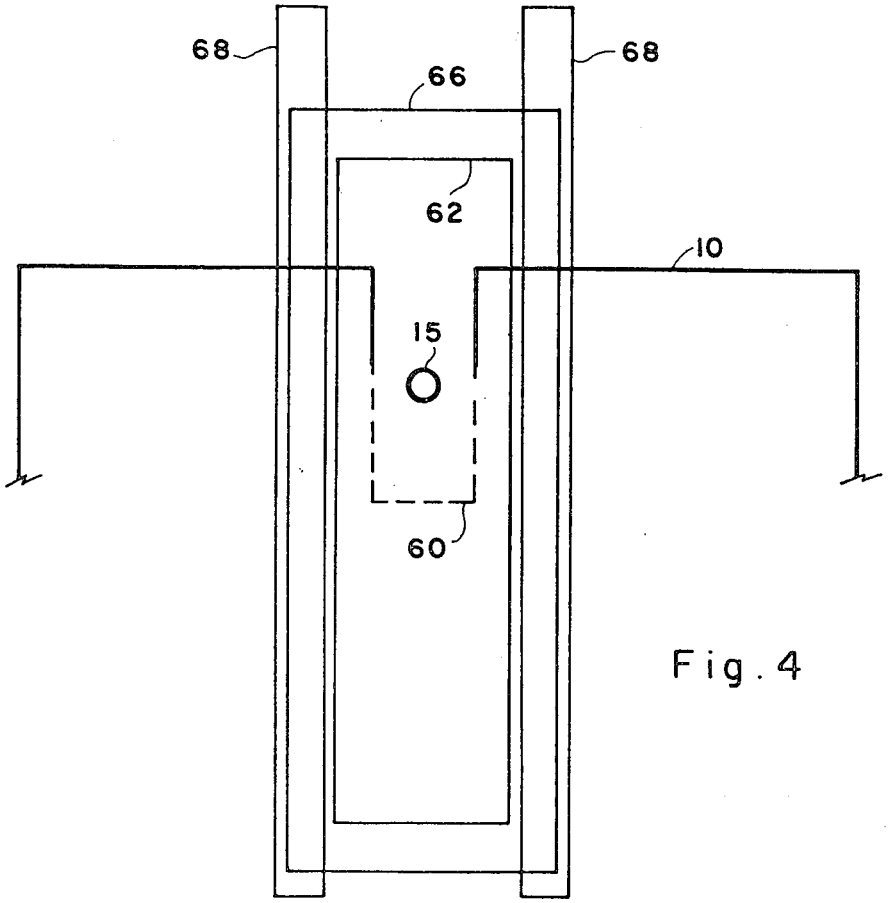

As to the mechanism, necessary to raise or lower the shaft with the containers out of the tub 10, for unloading purposes, or for parts' loading, various arrangements may be employed to achieve this end. In one embodiment, actually reduced to practice, the shaft 15 actually extended out of tub 10, and also out of tub 10', when the latter was used, so that the shaft stepping mechanism was always out of the electrolyte. Such an arrangement was found to be simpler and requiring less service and thus quite cheap. However since the shaft in the immersed state is deep below the electrolyte top level 14 and has to be raised significantly above it, electrolyte seals had to be provided in the opposite walls of tub 10 to prevent excessive leakage of electrolyte of the tub 10. This problem was solved by a unique arrangement which will be described in connection with FIGS. 3 and 4, which represent partial top and side views of one of the tub walls.

Briefly, a U-shaped slot 60 is formed in the tub wall to enable the shaft to be lowered below the tub's top. A pair of metal plates 61 and 62 with appropriate bearings 63 are used to support one end of the shaft. These plates are placed on opposite sides of the tub wall so as to cover the slot 60 when the shaft is in either the raised or lowered position. However to prevent excessive amounts of electrolyte from seeping out of the tub through slot 60 a pair of sheets of a plastic material e.g. teflon, designated by 65 and 66, are provided. They are held against the two opposite sides of the tub wall by L-shaped channels 68, between the metal plates 61 and 62.

As the shaft is raised by pulling on plates 61 and 62, the plates rise. The teflon sheets 65 and 66 which are connected to the plates rise with them by sliding in the channels 68. The teflon sheets are sufficiently long to cover the open slot 60 even when the shaft is in the raised position. Since the teflon sheets are positioned close to the tub wall they act as electrolyte seepage prevention seals. Thus the teflon sheets can be thought of as sliding liquid seals.

It should be stressed that a similar arrangement is provided on the opposite tub wall. Also, it should be pointed out that although two teflon sheets on opposite sides of the tub walls are shown, if desired, a single sheet on the wall side which is exposed to the electrolyte may suffice. This is true since the electrolyte presses against the teflon sheet thus bringing it in closer contact with the tub wall, sufficient for most liquid sealing purposes.

Although particular embodiments of the invention have been described and illustrated herein, it is recognised that modifications and variations may readily occur to those skilled in the art and consequently, it is intended that the claims be interpreted to cover such modifications and equivalents.

What we claim is:

1. An electropolishing system comprises:

a tub-like unit for containing a preselected electrolytic liquid therein;

a shaft at a predetermined location with respect to said tub-like unit and being rotatable about a horizontal axis;

at least one container connected to said shaft for containing parts to be electropolished, said container being formed of pervious substantially flat sides respectively perpendicular to adjacent one and at least one openable side through which said parts are adapted to be introduced into said container when said container is above said tub-like unit and is the top side of the container and is removed from said one openable side of the container when it is above the tub-like unit and is the bottom flat side of the container, said container being connected to said shaft whereby the container and parts therein are immersed in said liquid during at least a portion of each cycle of revolution of said shaft; and control means for steppingly rotating said shaft, whereby said shaft assumes n different positions and in each position a different flat side of the container which is in a horizontal plane serves as its bottom side, and for applying electical power of preselected voltage and current to said electrolyte liquid only when said shaft does not rotate and the container is in one of said positons.

2. An electropolishing system as recited in claim 1 including a plurality of containers connected to said shaft so that at each position thereof a different flat side of each container assumes the bottom side thereof.

3. An electropolishing system as recited in claim 2 wherein the number of containers is equal to n.

4. An electropolishing system as recited in claim 3 wherein n is an even number not less than 2.

5. An electropolishing system as recited in claim 1 further including means for raising said shaft and the container connected thereto above the electrolytic liquid for loading said container with parts to be polished and for unloading said container of polished parts.

6. An electropolishing system comprising;

a tub-like structure definable as a tub containing a preselected electrolyte;

a shaft adapted to be steppingly rotatable to assume n stationary positions during each revolution, where n is an integer;

n containers of a preselected shape connected to said shaft, each of said containers being of pervious sides so that electrolyte is adapted to flow thereinto the sides being mutually perpendicular to one another and further including one side defining a door which is adapted to be opened so as to enable metal parts to be polished to be introduced into the container when the door serves as the top side of the container and to remove said parts from said container, when the door is above the electrolyte and is the lowest side of container, said containers being shaped and connected to said shaft whereby in said shaft position a different side of each container acts as the bottom horizontal side thereof; and control means for controlling the stepping rotation of said shaft to assume each of said n positions in each revolution and for passing electric power through said electrolyte only when the shaft and the container therein are stationary at one of said positions.

* * * * *